United States Patent [19]

Conway

[11] Patent Number: 4,723,745

[45] Date of Patent: Feb. 9, 1988

[54] DISPLAY AND METHOD OF FORMING

[76] Inventor: Gerald A. Conway, Cleveland Heights, Ohio 44118

[21] Appl. No.: 878,669

[22] Filed: Jun. 26, 1986

[51] Int. Cl.[4] ..... A47B 96/06

[52] U.S. Cl. ..... 248/205.3; 40/2 R; 40/308

[58] Field of Search ..... 248/205.3, 205.2, 74.3; 24/265 R; 40/2 R, 359, 360, 308

[56] References Cited

U.S. PATENT DOCUMENTS

| | | | |
|---|---|---|---|
| 891,505 | 6/1908 | Smith | 40/360 |
| 2,336,867 | 12/1943 | Huber | 40/2 R X |
| 2,561,894 | 7/1951 | Wallich | 40/2 R X |
| 3,302,915 | 2/1967 | Usher | 248/74.3 |
| 3,677,250 | 7/1972 | Thomas | 248/205.3 X |
| 3,715,783 | 2/1973 | Parks et al. | 24/265 R |
| 4,188,427 | 2/1980 | Grass | 40/2 R X |
| 4,356,651 | 11/1982 | Barlow | 40/308 |
| 4,407,082 | 10/1983 | Stehouwer | 40/2 R X |
| 4,417,710 | 11/1983 | Adair | 248/205.3 X |
| 4,492,048 | 1/1985 | Brewer | 40/2 R |

*Primary Examiner*—Ramon O. Ramirez

*Attorney, Agent, or Firm*—Renner, Otto, Boisselle & Lyon

[57] ABSTRACT

A point of purchase display including a sign and a fastener made of a flat formable strip of clear vinyl or like bendable plastic material with adhesive surface portions on each side which may attach to the sign or to surfaces such as a shelf, wall or a window. The fastener may be bent to form a loop around a wire or rod and the ends attached to either side of a sign, without any surface adhesive connection to the rod or wire. Alternatively, the sign may be supported from such wall or window with the respective end secured to the wall or window and the sign to form a wobbler. For convenience, the strips may be manufactured by scoring a continuous sheet transversely which sheet may be coiled for packaging.

10 Claims, 6 Drawing Figures

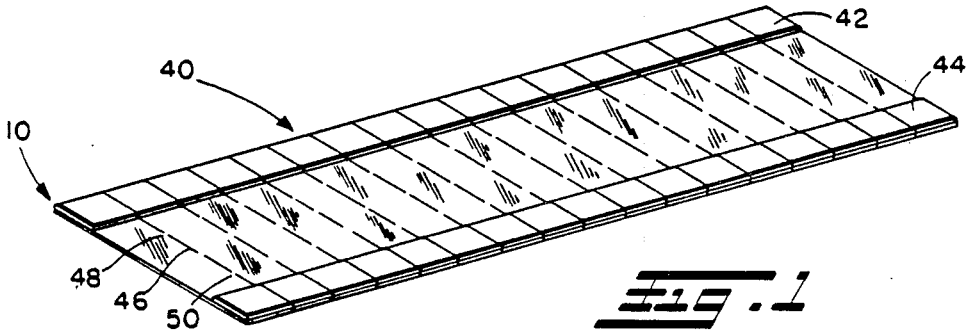
FIG. 1
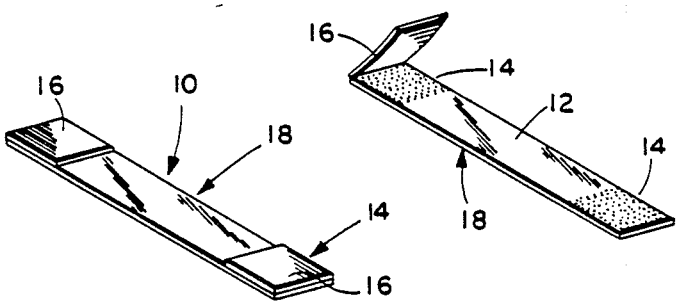
FIG. 3
FIG. 2
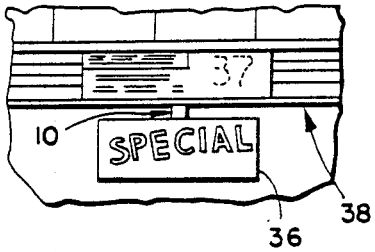
FIG. 6
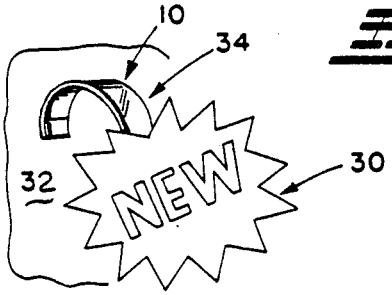
FIG. 5
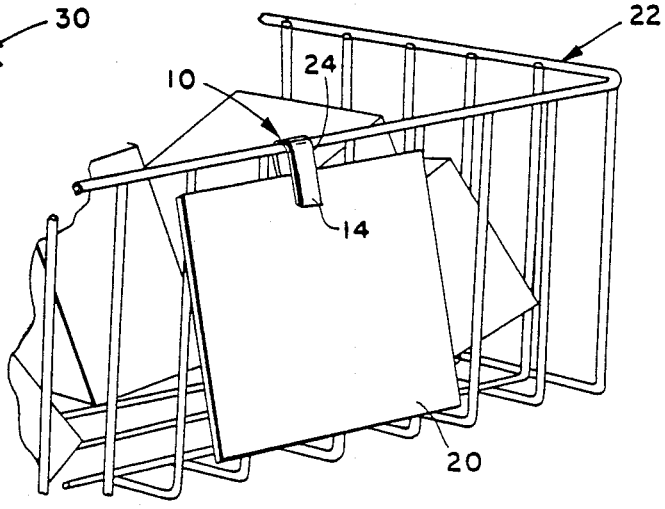
FIG. 4

DISPLAY AND METHOD OF FORMING

TECHNICAL FIELD

The invention is directed generally to displays and in particular to a display for point of purchase marketing and a method for forming such display.

BACKGROUND

Displays are well known. One commonly finds displays in grocery or drug stores announcing prices, new items, or providing take-one pads for items. The displays use fasteners to attach signs and the like to display shelves, baskets, windows, etc. An example of such a fastener is a clip which a grocer uses to clip a sign to a basket or grocery shelf which announces a reduced price for an item. Also used for such purposes are plastic rings. Reference may be had to applicant's prior U.S. Pat. Nos. 4,477,048, 4,301,987, and 4,277,434 for examples of such clips or rings.

Many retailers, however, resort to using lower cost cellophane adhesive tape as a display fastener because of its multi-purpose uses. Signs can be taped to windows or walls or to display shelves whereas clips cannot attach a sign to a window. Additionally, a single roll of tape may fasten many signs and may easily be stored. A quantity of loose clips, on the other hand, requires more storage and inventory tracking.

Unfortunately, the use of cellophane adhesive tape is generally messy. When a sign is removed the cellophane tape usually tears and a portion is left behind. Sometimes the remaining portion is simply left behind only to be covered by more tape at a future date. Other times, the remaining portion is removed after some effort to pick at an edge until the portion can be grasped. Even with the tape removed, there still may be a mess due to the adhesive residue left behind.

Additionally, the use of cellophane tape as a fastener for display signs creates displays which are unattractive. Dirt may adhere to the edges of the tape and may create dirty edges on the sign. Preferably, a display fastener should be low cost, easy to store, detach easily from a display and leave no messy adhesive residue when removed from a display shelf, basket, etc. It should also have a multiplicity of applications and uses.

SUMMARY OF THE INVENTION

The invention relates to a flexible clear plastic strip with an adhesive surface portion on a common side at both of its ends with the major center portion free of adhesive. The strip is attached to a sign, to a display shelf or the like, or to any surface such as a wall, window or case, to form a display. One adhesive end sticks to the sign while the other sticks to the shelf or window. Additionally, the strip is flexible enough to bend around wires or rods without splitting, cracking or breaking. Thus the strip can be bent around a rod or wire of a basket and both ends attached to either side of a sign to hang the sign from the rod or basket. The result is an attractive fastener which leaves no adhesive residue.

In another application the strip may be used as a wobbler. A wobbler is a form of display where the sign is free to move or wobble, such movement being caused normally by slight air currents caused, for example, by someone walking or by heating or air conditioning systems. In such application, one end of the strip is attached to any surface while the other is attached to the display. The weight of the display causes the strip to bend into an inverted U-shape configuration permitting the wobbling action.

These and other objects, advantages and aspects will become more apparent as the following description proceeds.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

In the annexed drawings:

FIG. 1 is a perspective view of an unrolled roll or package of fasteners in accordance with the present invention;

FIG. 2 is a perspective view of a single fastener;

FIG. 3 is another perspective view of a single fastener with the adhesive protective film removed to expose adhesive surfaces;

FIG. 4 is a view of a display in which a fastener is used to attach a sign to a wire basket;

FIG. 5 is a view of a display in which a fastener is used to form a wobbler display; and FIG. 6 is a view of a display in which a fastener is used to attach a sign under a display shelf.

DETAILED DESCRIPTION OF A PREFERRED EMBODIMENT

The fastener 10 of the present invention is shown in FIGS. 2 and 3. The major component of the fastener 10 is the plastic strip 12 which preferably is made of a thin sheet of vinyl or other clear flexible bendable material which exhibits a certain amount of stiffness and resiliency so that it can be bent around a rod or the like to form a loop without splitting, breaking or cracking and capable of retaining its bent shape.

End portions 14 both form a substantially square area having a layer of adhesive. As indicated, in the preferred embodiment the adhesive surfaces of both end portions 14 are located on the same side of the plastic strip 12. However, placement of the adhesive of each end portion on opposite sides of the plastic strip or even on both sides of the plastic strip is contemplated by the invention.

The end portions 14 with adhesive placed thereon are protected by adhesive protective layers 16 as is shown in FIG. 3. The protective layers 16 protect the adhesive during shipping and storage. Prior to application of the fastener, the protective layers are removed or peeled off as seen in FIG. 3 exposing the adhesive so that the end portions 14 may be attached to surfaces by pressing the end portions on surfaces and allowing the adhesive to adhere the end portions to such surfaces.

As is apparent, the fastener includes a major center portion which is free of adhesive as indicated at 18. The overall length of the strip may be approximately two inches in length and 3/16 inch wide. Since the end portions 14 are essentially square, the major clear portion is approximately 1§ inches long. This enables the strip to form a loop readily encircling most wires or rods used in containers for point of purchase marketing. It also readily enables the strip to bend to an inverted U-shape configuration when supporting a display as a wobbler. The fact that the major center portion is clear or transparent does not detract from the sign or display.

FIGS. 4, 5 and 6 show typical applications of the instant invention. In FIG. 4 the fastener 10 is used to hang a sign 20 to the top of a wire basket 22. One end portion 14 is attached to the sign. The plastic strip 12 is bent around the wire to form a loop shown generally at 24. The other end portion may then be attached to the other side or rear of the sign.

In FIG. 5, the fastener 10 is used with a sign 30 to create a wobbler display. One end portion 14 is attached to the back of sign 30 while the other end portion may be placed on a window or any other flat surface 32. The fastener due to the weight of the sign bends to form an inverted U-shape curve indicated at 34 so that the sign will stick out as well as wobble.

In FIG. 6, the fastener 10 is shown being used to hold sign 36 from a display shelf pricing channel 38. One end portion 14 is stuck to the back of the sign while the other is stuck to the underside of a display shelf 38 or back of the pricing channel. In FIG. 6, the sign is simply pendently supported from the shelf, but the flexibility of the fastener nonetheless permits a somewhat minimized wobble effect. This effect can be reduced simply by lowering the point on the back of the sign or display to which the fastener is attached thus reducing the clearance between the top of the sign and the underside of the shelf pricing channel.

As is shown in FIG. 1, the fasteners 10 may be manufactured from a continuous strip 40 which is as wide as the individual fasteners are long. The end sections of adhesive and the layer covering of such end sections may be applied in a continuous operation to the edges of such strip only as seen at 42 and 44. The continuous strip 40 is then transversely die cut as seen at 46 to form the individual fastener sections 10. The die cutting operation may leave two or more uncut small portions seen at 48 and 50 to maintain the strip 40 as a package. In this manner, each individual strip 10 may then readily be torn or separated from the package. The strip 40 may readily be rolled for storage or packaging and may be provided with a roll or package pull-out or off, tear-off package or dispenser.

In any event the fastener of the present invention is low cost, disposable, readily packaged, conveniently stored and usable, and has a wide variety of applications in point of purchase marketing.

While a preferred embodiment of the invention has been disclosed, it will be understood that various modifications obvious to those skilled in the art can be made thereto without departing from the spirit and scope of the invention as covered by the appended claims.

What is claimed is:

1. A display comprising in combination a fastener and a display sign, said fastener comprising a flat narrow rectangular strip made of flexible yet formable plastic material with end portions located at the ends of the major length of the strip, said end portions comprising adhesive means for adhesively attaching each of said end portions to a surface, said adhesive means being located on the same flat side of said strip, said display sign comprising at least one major surface for conveying a message to a viewer, wherein one of said end portions is attached to the display sign and the other end is attached to a surface.

2. A display as set forth in claim 1 wherein said rectangular strip includes a center portion located between said end portions, said center portion being free of adhesive.

3. A display comprising a fastener and a sign with front and back surfaces, said fastener comprising a flat narrow rectangular strip made of flexible yet formable plastic material with end portions located at the ends of the major length of the strip, said end portions comprising adhesive means for adhesively attaching each of said end portions to a surface, said adhesive means being located on the same flat side of said strip, said fastener being bent to form a loop, and one of said end portions being attached to the front surface of the display and the other end portion being attached to the back surface of the display.

4. A display as set forth in claim 3 wherein said rectangular strip includes a center portion located between said end portions, said center portion being free of adhesive.

5. A method for forming a display comprising:

attaching one end portion of a fastener which comprises a flat narrow rectangular strip made of flexible yet formable plastic material with end portions located at the ends of the major length of the strip, said end portions comprising adhesive means for adhesively attaching each of said end portions to a surface, attaching one of said end portions to a sign surface, and attaching the other end portion of said fastener to a surface.

6. A method as set forth in claim 5 wherein said fastener further includes removable adhesive protective layers for protecting said adhesive means and at least one of said protective layers is removed from said adhesive means of one of said end portions before said step of attaching one of said end portions to a sign surface.

7. A method for forming a display comprising:

attaching one end portion of a fastener which comprises a flat narrow rectangular strip made of flexible yet formable plastic material with end portions located at the ends of the major length of the strip, said end portions comprising adhesive means for adhesively attaching each of said end portions to a surface, attaching one of said end portions to a sign surface;

bending the fastener to form a loop; and attaching the other end portion of said fastener to a sign surface.

8. A method as set forth in claim 7 wherein said fastener further includes removable adhesive protective layers for protecting said adhesive means and at least one of said protective layers is removed from said adhesive means of one of said end portions before said step of attaching one of said end portions to a sign surface.

9. A method of manufacturing a display fastener comprising applying adhesive and protective layers to the edges only of a continuous flexible yet formable plastic strip, transversely die cutting the strip except at tear points to form a continuous roll of individual such fasteners whereby such fasteners may be removed one or more at a time from the continuous roll.

10. A roll of display fasteners comprising a rectangular strip of flexible yet formable plastic material with adhesive and protective layers located on the ends of the minor length of the strip, said strip being transversely die cut except at tear points to form a plurality of detatchable display fasteners comprising flat narrow rectangular strips with end portions located at the ends of the major lengths of the transversely die cut strips, said end portions comprising adhesive means for adhesively attaching each of said end portions to a surface, said adhesive means being located on the same flat side of said strip.

* * * * *